US012220022B2

(12) United States Patent
Yang

(10) Patent No.: US 12,220,022 B2
(45) Date of Patent: Feb. 11, 2025

(54) HARD-SHELL BOOT

(71) Applicant: SOLEX (XIAMEN) INTERNATIONAL TRADE CO., LTD., Xiamen (CN)

(72) Inventor: Tze-Hsuan Yang, Xiamen (CN)

(73) Assignee: SOLEX (XIAMEN) INTERNATIONAL TRADE CO., LTD., Xiamen (CN)

( * ) Notice: Subject to any disclaimer, the term of this patent is extended or adjusted under 35 U.S.C. 154(b) by 173 days.

(21) Appl. No.: 18/151,630

(22) Filed: Jan. 9, 2023

(65) Prior Publication Data

US 2024/0172843 A1 May 30, 2024

(30) Foreign Application Priority Data

Nov. 28, 2022 (TW) ..... 111213140

(51) Int. Cl.
*A43C 11/14* (2006.01)
*A43B 5/16* (2006.01)

(52) U.S. Cl.
CPC ..... *A43C 11/14* (2013.01); *A43B 5/16* (2013.01)

(58) Field of Classification Search
CPC ..... A43B 5/16; A43C 11/00; A43C 11/08; A43C 11/12; A43C 11/18; A43C 11/20; A43C 11/22; Y10T 24/3742; Y10T 24/3676
See application file for complete search history.

(56) References Cited

U.S. PATENT DOCUMENTS 250,447 A * 12/1881 Leiboldt ..... A43C 11/1406 24/71 SK
827,987 A * 8/1906 Miles et al. ..... A43D 11/08 12/113
915,755 A * 3/1909 Ellis ..... A43C 11/18 12/113
1,283,014 A * 10/1918 Young ..... A43C 11/18 12/113
1,353,424 A * 9/1920 Santos ..... A43C 11/00 24/437
1,362,459 A * 12/1920 Sigmund ..... A43C 11/00 24/71 R (Continued)

*Primary Examiner* — Heather Mangine
(74) *Attorney, Agent, or Firm* — Muncy, Geissler, Olds & Lowe, P.C.

(57) ABSTRACT

A hard-shell boot comprises a boot liner and an outer shell having an accommodation space for accommodating and positioning the boot liner. Two sides of a top portion of the outer shell respectively have a first flank portion vertically penetrated by a first-through-hole and a second flank portion vertically penetrated by a second-through-hole. A connecting member comprises an inner-blocking-piece located in an inner side of the top portion of the outer shell and an outer-blocking-piece. One end and the other end of the inner-blocking-piece respectively have a first-engaging-portion connected to one end of the outer-blocking-piece by passing upward through the first-through-hole and a second-engaging-portion connected to the other end of the outer-blocking-piece by passing upward through the second-through-hole. Thus, the width and size of the hard-shell boot can be adjusted simultaneously to facilitate the use of users with different foot widths and sizes.

3 Claims, 3 Drawing Sheets

(56) References Cited

U.S. PATENT DOCUMENTS 1,493,710 A * 5/1924 Smith ..... A43C 11/00 24/71 SK
1,584,201 A * 5/1926 Szastalo ..... A43C 11/18 24/437
1,741,876 A * 12/1929 Prima ..... A43C 11/00 24/71 SK
2,046,079 A * 6/1936 MacIntosh ..... A44C 5/24 63/3
2,926,408 A * 3/1960 Smith ..... A44B 11/02 24/191
3,205,544 A * 9/1965 Streule ..... A43C 11/1493 24/306
3,403,429 A * 10/1968 Smith ..... A44B 18/0069 24/442
3,808,645 A * 5/1974 Chow ..... A43C 11/1406 24/71 SK
3,939,583 A * 2/1976 Daumann ..... A43B 5/16 280/11.3
4,094,029 A * 6/1978 Carlile ..... A43C 11/18 24/267
4,777,705 A * 10/1988 Ingram ..... A43D 999/00 24/575.1
4,790,048 A * 12/1988 Arnt ..... A43C 7/00 24/712.1
5,203,053 A * 4/1993 Rudd ..... A43C 11/00 24/442
5,214,826 A * 6/1993 Fortune ..... A43C 11/22 24/575.1
5,295,315 A * 3/1994 Osawa ..... A43C 11/22 24/712
5,467,508 A * 11/1995 Feng ..... A44B 11/06 24/191
5,526,585 A * 6/1996 Brown ..... A43C 11/22 36/52
5,564,203 A * 10/1996 Morris ..... A43B 23/22 36/50.1
5,582,417 A * 12/1996 Schaper ..... A63C 17/068 280/11.27
5,640,744 A * 6/1997 Allan ..... B29C 43/222 24/584.1
5,692,276 A * 12/1997 Paxton ..... A43C 11/10 24/712.1
5,848,457 A * 12/1998 Silagy ..... A43C 11/22 24/713.9
5,894,640 A * 4/1999 Dewey ..... A43C 11/00 24/575.1
5,909,946 A * 6/1999 Okajima ..... A43C 11/008 36/50.1
6,701,589 B1 * 3/2004 Kliewer ..... A43C 11/22 24/712
7,313,849 B2 * 1/2008 Liu ..... A43C 11/24 24/712.1
9,914,385 B1 * 3/2018 Stuckey ..... A44B 11/065
10,010,138 B1 * 7/2018 Nicholson ..... A43C 5/00
2006/0080814 A1 * 4/2006 Kim ..... A43C 7/08 24/712.1
2006/0117606 A1 * 6/2006 Chen ..... A43C 11/00 36/91
2013/0263473 A1 * 10/2013 Young ..... A43C 11/22 24/713.6
2014/0047739 A1 * 2/2014 Senegal ..... A43C 11/00 36/97
2017/0049188 A1 * 2/2017 Shirley ..... A43C 11/20
2020/0054100 A1 * 2/2020 Spicher ..... A44B 11/065
2024/0172834 A1 * 5/2024 Yang ..... A43B 5/1683
2024/0172843 A1 * 5/2024 Yang ..... A43C 11/14

* cited by examiner

HARD-SHELL BOOT

FIELD OF THE INVENTION

The present invention is related to a hard-shell boot, especially a hard-shell boot capable of being adjusted simultaneously according to the width and size of the user's foot.

BACKGROUND OF THE INVENTION

Inline skating has become a very popular sport in recent years, especially for young people. The inline skating boots are the necessary equipment for inline skating. The inline skating boot is mainly formed by assembling a hard-shell boot on a set of inline skating wheels. Structurally, hard-shell boot mainly comprises an outer shell and a boot liner. Although some outer shells have structures with adjustable length and width respectively, the adjustment structures for length and width are separated and must be adjusted by hand tool separately, which is quite inconvenient in actual use.

SUMMARY OF THE INVENTION

Accordingly, the present invention has developed a new design which may avoid the above-described drawbacks, may significantly enhance the performance of the devices, and may take into account economic considerations. Therefore, the present invention then has been invented.

The main object of the present invention is to provide a hard-shell boot which can solve the problem that the outer shell of conventional hard-shell boot cannot be adjusted in width and size simultaneously. Through providing two through holes on two flank portions of a top portion of the outer shell respectively, two ends of an inner blocking piece are connected to two ends of an outer blocking piece respectively by passing upward through the two through holes respectively, so that the two flank portions are capable of being relatively stretched to be adjusted according to the width and size of the user's foot. And it can effectively prevent the user's foot from dislocation during exercise.

In order to achieve the object of the present invention, the present invention provides a hard-shell boot, which comprises an outer shell and a boot liner. The outer shell has an accommodation space for accommodating and positioning the boot liner. Two sides of a top portion of the outer shell have a first flank portion and a second flank portion respectively. The first flank portion and the second flank portion are connected and positioned by a connecting member. The hard-shell boot is mainly characterized in that: the first flank portion has a first through hole penetrating through the first flank portion vertically; the second flank portion has a second through hole penetrating through the second flank portion vertically; and the connecting member comprises an inner blocking piece and an outer blocking piece, the inner blocking piece is located in an inner side of the top portion of the outer shell, one end of the inner blocking piece has a first engaging portion, the first engaging portion is connected to one end of the outer blocking piece by passing upward through the first through hole, the other end of the inner blocking piece has a second engaging portion, the second engaging portion is connected to the other end of the outer blocking piece by passing upward through the second through hole.

In implementation, the one end of the inner blocking piece further has a first position-constrained portion for abutting against an inner side of the first flank portion after the first engaging portion passing through the first through hole; the other end of the inner blocking piece further has a second position-constrained portion for abutting against an inner side of the second flank portion after the second engaging portion passing through the second through hole.

In implementation, the outer blocking piece comprises a first bending portion and a second bending portion, one end of the first bending portion is connected to the first engaging portion, the other end of the first bending portion is pivoted to one end of the second bending portion, the other end of the second bending portion is connected to the second engaging portion.

In implementation, the first bending portion comprises a first buckle ring and a first blocking rod, one end of the first buckle ring is connected to the first engaging portion, the other end of the first buckle ring is pivoted to one end of the first blocking rod; the second bending portion comprises a second buckle ring and a second blocking rod, one end of the second buckle ring is connected to the second engaging portion, the other end of the second buckle ring is pivoted to one end of the second blocking rod, the other end of the second blocking rod is pivoted to the other end of the first blocking rod.

For further understanding the characteristics and effects of the present invention, some preferred embodiments referred to drawings are in detail described as follows.

DETAILED DESCRIPTIONS OF PREFERRED EMBODIMENTS

Figure 1:
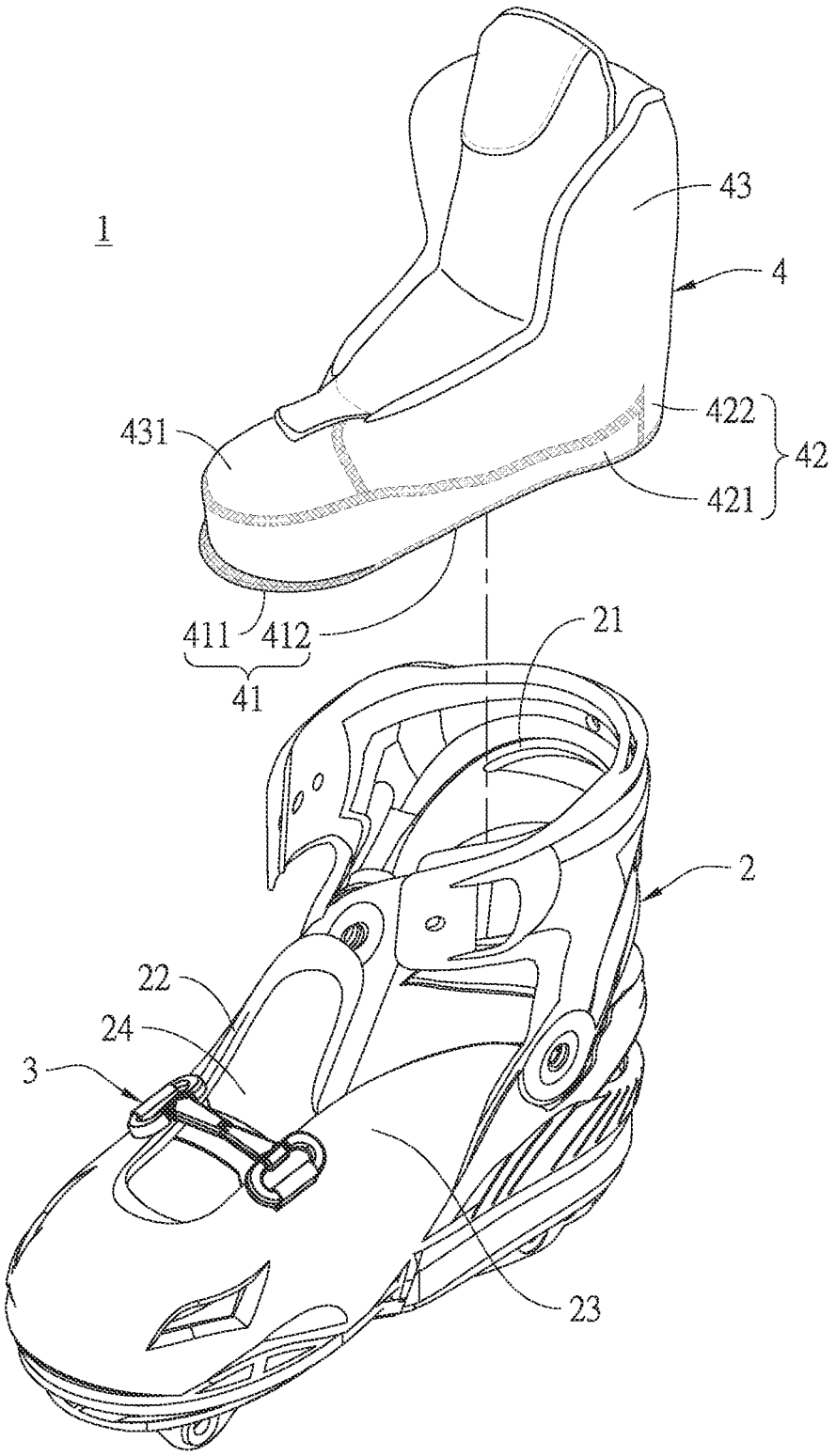
FIG. 1 is an exploded view of components of a preferred embodiment of the present invention.
Figure 2:
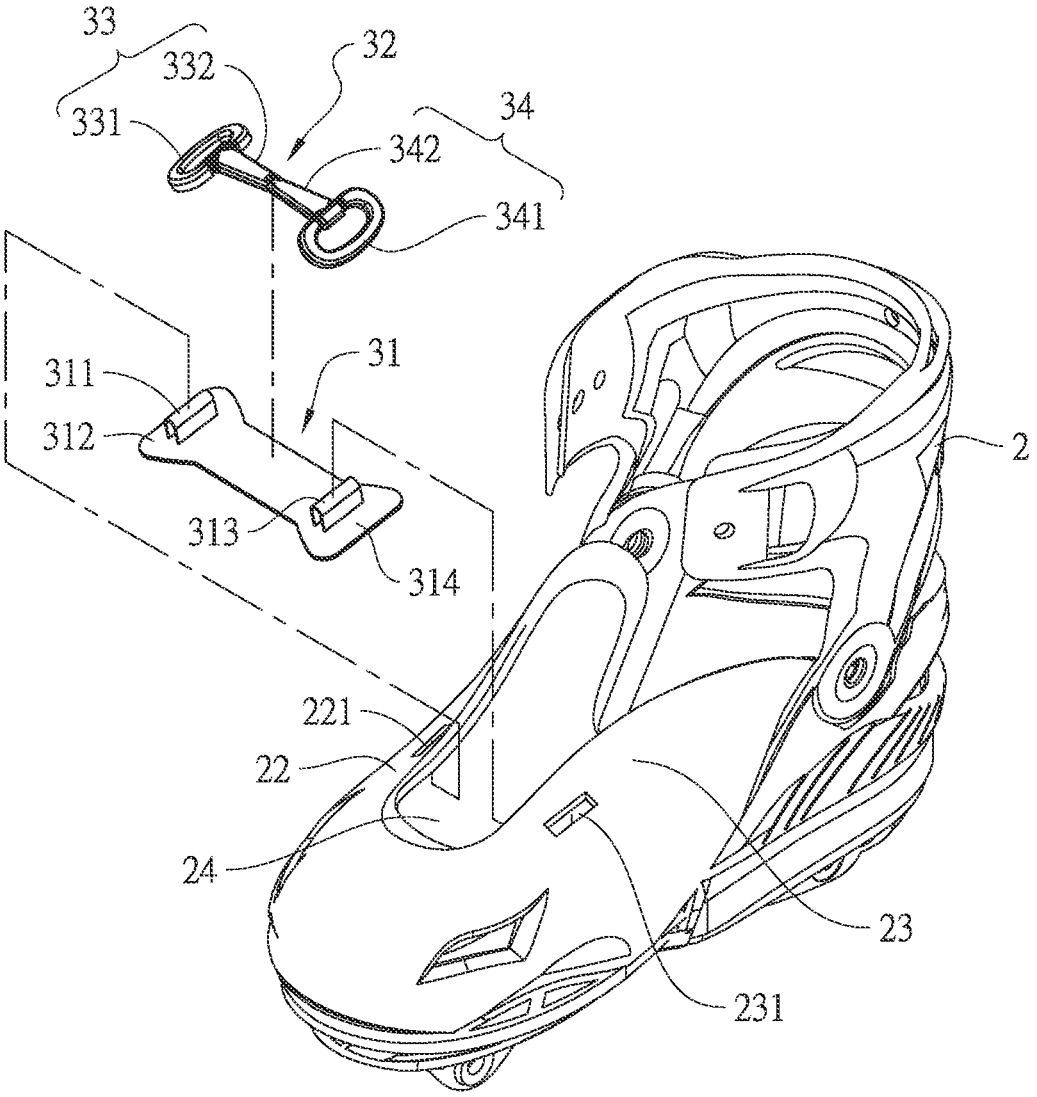
FIG. 2 is an exploded view of components of outer shell and connecting member of a preferred embodiment of the present invention.
Figure 3:
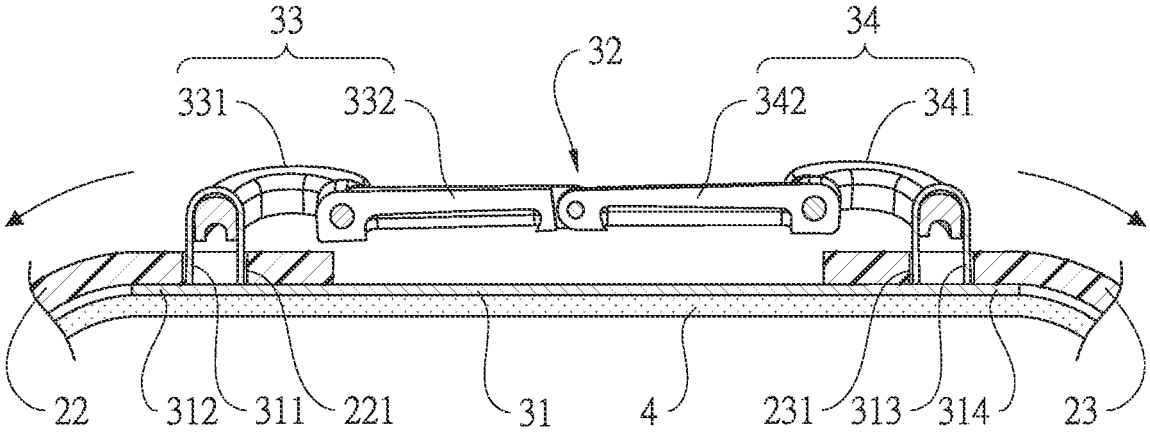
FIG. 3 is a cross-sectional schematic view of a preferred embodiment of the present invention.

Please refer to FIGS. 1-3, a preferred embodiment of hard-shell boot 1 of the present invention is shown. The hard-shell boot 1 comprises an outer shell 2, a connecting member 3 and a boot liner 4. A bottom of the outer shell 2 is assembled with a set of inline skating wheels for users to engage in inline skating. The outer shell 2 has an accommodation space 21 with a top opening. The accommodation space 21 is used for accommodating and positioning the boot liner 4. The boot liner 4 is used for accommodating user's foot. Two sides of a top portion of a front half of the outer shell 2 have a first flank portion 22 and a second flank portion 23 respectively. A gap 24 is between the first flank portion 22 and the second flank portion 23. One side of the first flank portion 22 has a first through hole 221 penetrating through the first flank portion 22 vertically. One side of the second flank portion 23 has a second through hole 231 penetrating through the second flank portion 23 vertically. Two ends of the connecting member 3 are connected and positioned to the first flank portion 22 and the second flank portion 23 respectively, so that the gap 24 is capable of being expanded or shrank, or the first flank portion 22 and the second flank portion 23 are capable of being expanded upward or shrank downward.

The connecting member 3 comprises an inner blocking piece 31 and an outer blocking piece 32. The inner blocking piece 31 may be a flexible elongated sheet located in an inner side of the top portion of the front half of the outer shell 2. One end of the inner blocking piece 31 has a sleeve ring and a first position-constrained portion 312. The sleeve ring can be used as a first engaging portion 311. The first engaging portion 311 is connected to one end of the outer blocking piece 32 by passing upward through the first through hole 221. And the first position-constrained portion 312 is abutted upward against an inner side of the first flank portion 22. The other end of the inner blocking piece 31 has the other sleeve ring and a second position-constrained portion 314. Said the other sleeve ring can be used as a second engaging portion 313. The second engaging portion 313 is connected to the other end of the outer blocking piece 32 by passing upward through the second through hole 231. And the second position-constrained portion 314 is abutted upward against an inner side of the second flank portion 23. Thus, the two ends of the inner blocking piece 31 are unidirectionally positioned on the inner side of the top portion of the front half of the outer shell 2 respectively.

The outer blocking piece 32 comprises a first bending portion 33 and a second bending portion 34. The first bending portion 33 comprises a first buckle ring 331 and a first blocking rod 332. The first engaging portion 311 is sleeved on one end of the first buckle ring 331, so that the one end of the first buckle ring 331 is connected to the first engaging portion 311. The other end of the first buckle ring 331 is pivoted to one end of the first blocking rod 332. The second bending portion 34 comprises a second buckle ring 341 and a second blocking rod 342. The second engaging portion 313 is sleeved on one end of the second buckle ring 341, so that the one end of the second buckle ring 341 is connected to the second engaging portion 313. The other end of the second buckle ring 341 is pivoted to one end of the second blocking rod 342. The other end of the second blocking rod 342 is pivoted to the other end of the first blocking rod 332. Thus, through bending the inner blocking piece 31 and bending the outer blocking piece 32, the gap 24 between the first flank portion 22 and the second flank portion 23 is capable of being expanded or shrank, or the first flank portion 22 and the second flank portion 23 are capable of being expanded upward or shrank downward, so as to accommodate users with different foot widths and sizes, and effectively prevent the user's foot from dislocation during exercise.

The boot liner 4 has a sole 41. The sole 41 comprises a first elastic sheet 411 and a rear bottom sheet 412 on the same level. The first elastic sheet 411 is an elastic cloth. The rear bottom sheet 412 is jointed to a rear side of the first elastic sheet 411. An outer periphery of the sole 41 is extended upward to form an upright portion 42. The upright portion 42 comprises a second elastic sheet 421 and a rear upright sheet 422. The second elastic sheet 421 is an elastic cloth. Two ends of a rear side of the second elastic sheet 421 are jointed to two ends of a front side of the rear upright sheet 422 respectively. An outer periphery of a top portion of the upright portion 42 is extended upward to form a sleeve portion 43. A front end of the sleeve portion 43 has a third elastic sheet 431. The third elastic sheet 431 is an elastic cloth. In implementation, the outer periphery of the sole 41 is sewn to an outer periphery of a bottom portion of the upright portion 42; an outer periphery of a top portion of the second elastic sheet 421 is sewn to the sleeve portion 43. Thus, when the user's foot is put into the boot liner 4, the space for the foot is capable of being expanded upward through the elastic effect of the first elastic sheet 411 and the second elastic sheet 421; the space for the foot is capable of being expanded laterally through the elastic effect of the second elastic sheet 421; while, through the collaborative elastic effect of the first elastic sheet 411, the second elastic sheet 421 and the third elastic sheet 431, the space for the foot is capable of being expanded forward to facilitate the use of users with different foot lengths and sizes.

As disclosed in the above description and attached drawings, the present invention can provide a hard-shell boot, in which the two flank portions are capable of being relatively stretched to be adjusted according to the width and size of the user's foot, so as to facilitate the use of users with different foot lengths and sizes, and it can effectively prevent the user's foot from dislocation during exercise. It is new and can be put into industrial use.

Although the embodiments of the present invention have been described in detail, many modifications and variations may be made by those skilled in the art from the teachings disclosed hereinabove. Therefore, it should be understood that any modification and variation equivalent to the spirit of the present invention be regarded to fall into the scope defined by the appended claims.

What is claimed is:

1. A hard—shell boot, which comprises an outer shell and a boot liner, said outer shell has an accommodation space for accommodating and positioning said boot liner, two sides of a top portion of said outer shell have a first flank portion and a second flank portion respectively, said first flank portion and said second flank portion are connected and positioned by a connecting member, said hard-shell boot is characterized in that:

said first flank portion has a first through hole penetrating through said first flank portion vertically;

said second flank portion has a second through hole penetrating through said second flank portion vertically; and said connecting member comprises an inner blocking piece and an outer blocking piece, wherein said outer blocking piece comprises a first bending portion and a second bending portion, said inner blocking piece is located in an inner side of said top portion of said outer shell, and a first end of said inner blocking piece has a first engaging portion, said first engaging portion is connected to a first end of said first bending portion of said outer blocking piece by passing upward through said first through hole, a second end of said first bending portion is pivoted to a first end of said second bending portion, a second end of said inner blocking piece has a second engaging portion, said second engaging portion is connected to a second end of said second bending portion of said outer blocking piece by passing upward through said second through hole.

2. The hard-shell boot according to claim 1, wherein said first end of said inner blocking piece further has a first position-constrained portion for abutting against an inner side of said first flank portion after said first engaging portion passing through said first through hole; said the second end of said inner blocking piece further has a second position-constrained portion for abutting against an inner side of said second flank portion after said second engaging portion passing through said second through hole.

3. The hard-shell boot according to claim 1, wherein said first bending portion comprises a first buckle ring and a first blocking rod, a first end of said first buckle ring is connected to said first engaging portion, a second end of said first buckle ring is pivoted to a first end of said first blocking rod; said second bending portion comprises a second buckle ring and a second blocking rod, a first end of said second buckle ring is connected to said second engaging portion, a second end of said second buckle ring is pivoted to a first end of said second blocking rod, a second end of said second blocking rod is the first end of the second bending portion and a second end of said first blocking rod is the second end of the first bending portion so that the second end of the second blocking rod is pivoted to the second end of the first blocking rod.

* * * * *